US009226534B2

(12) United States Patent
Puni

(10) Patent No.: US 9,226,534 B2
(45) Date of Patent: Jan. 5, 2016

(54) SHOULDER STABILIZATION SHIRT

(71) Applicant: Vishal Puni, Montreal (CA)

(72) Inventor: Vishal Puni, Montreal (CA)

( * ) Notice: Subject to any disclaimer, the term of this patent is extended or adjusted under 35 U.S.C. 154(b) by 0 days.

(21) Appl. No.: 14/101,497

(22) Filed: Dec. 10, 2013

(65) Prior Publication Data

US 2015/0157068 A1 Jun. 11, 2015

Related U.S. Application Data

(63) Continuation-in-part of application No. PCT/IB2012/001111, filed on Jun. 7, 2012.

(60) Provisional application No. 61/495,655, filed on Jun. 10, 2011.

(51) Int. Cl.

| | |
|---|---|
| ***A41D 13/05*** | (2006.01) |
| ***A41B 1/08*** | (2006.01) |
| *A41D 27/06* | (2006.01) |

(52) U.S. Cl.

CPC ..... *A41D 13/0512* (2013.01); *A41B 1/08* (2013.01); *A41D 13/0518* (2013.01); *A41D 27/06* (2013.01); *A41D 2400/32* (2013.01); *A41D 2400/322* (2013.01); *A41D 2400/38* (2013.01); *A41D 2600/20* (2013.01)

(58) Field of Classification Search

CPC ..... A41D 2400/32; A41D 2400/322; A41D 2400/38; A41D 2600/20; A41D 27/06

See application file for complete search history.

(56) References Cited

U.S. PATENT DOCUMENTS

| | | | | |
|---|---|---|---|---|
| 5,857,947 | A * | 1/1999 | Dicker et al. | 482/124 |
| 5,857,990 | A * | 1/1999 | Maas | 602/62 |
| 5,937,442 | A | 8/1999 | Yamaguchi et al. | |
| 6,440,094 | B1 * | 8/2002 | Maas | 602/5 |
| 7,089,597 | B2 * | 8/2006 | Horii et al. | 2/69 |
| 7,134,969 | B2 * | 11/2006 | Citron et al. | 473/277 |
| 8,533,864 | B1 * | 9/2013 | Kostrzewski | 2/69 |
| 2005/0197607 | A1 * | 9/2005 | Brown | 602/19 |
| 2010/0088803 | A1 * | 4/2010 | Orloff | 2/228 |
| 2011/0302686 | A1 * | 12/2011 | Chapuis | 2/69 |
| 2012/0059297 | A1 * | 3/2012 | Newkirk | 602/19 |
| 2012/0156962 | A1 * | 6/2012 | Krawchuk | 450/92 |
| 2013/0104280 | A1 * | 5/2013 | Boynton | 2/79 |
| 2013/0167285 | A1 * | 7/2013 | Decker | 2/69 |
| 2014/0317826 | A1 * | 10/2014 | Decker | 2/69 |

FOREIGN PATENT DOCUMENTS

JP 2006291399 A 10/2006

OTHER PUBLICATIONS

International Search Report of PCT/IB2012/001111 Dated Oct. 9, 2012.

* cited by examiner

*Primary Examiner* — Khoa Huynh
*Assistant Examiner* — Khaled Annis
(74) *Attorney, Agent, or Firm* — Venable LLP; Robert Kinberg

(57) ABSTRACT

An upper-body stabilization garment includes a front portion to contact a front upper-body region of a subject, and a rear portion to contact a rear upper-body region of the subject. A plurality of elastomeric strips form an X-pattern on the front and or rear of the garment. The strips forming the X-pattern have at least one end attached to a side seam of the garment.

6 Claims, 19 Drawing Sheets

SHOULDER STABILIZATION SHIRT

CROSS REFERENCE TO RELATED APPLICATIONS

This application is a continuation-in-part of International Application No. PCT/IB/2012/001111, filed Jun. 7, 2012, claiming priority to U.S. Provisional Application No. 61/495,655, filed Jun. 10, 2011, the contents of both applications being incorporated herein by reference in their entireties.

BACKGROUND

The present invention relates to garments, and more particularly to garments known generally in the art as compression shirts or shoulder stabilization shirts.

Compression shirts are garments worn by individuals for a variety of purposes, but are primarily worn by active individuals and athletes participating in sports activities. Essentially, a compression shirt serves as a type of upper body girdle, providing compressive support to several areas of the wearer's body, including the shoulders, arms, torso, chest, back and abdomen areas. Compression shirts are often used by individuals during sports activities to reduce muscle fatigue, improve thermoregulation by wicking perspiration away from the body, and maintaining muscle warmth to reduce the potential for muscle strains. These garments may be worn by individuals as a preventative measure, or to provide additional support for areas weakened by injury.

Compression shirts are often manufactured using stretchable or elastomeric fabrics such as nylon, polyester, Lycra™ and Spandex™. Typically, a compression shirt is constructed such that this elastomeric fabric is placed in tension when the shirt is pulled onto the wearer's body, thereby providing some degree of compressive support for the wearer. The particular part of the body receiving this compressive support depends upon the nature of the construction of the garment.

Simple shirt's, although capable of providing some general level of compression to portions of a user's body, generally do not target such compression to a particular area of the wearer's body and not to others; rather, they simply "squeeze" whatever portion of the body the fabric overlies.

Further, such shirts do not'necessarily provide resistance to undesired ranges of movement. They do not provide any specific resistance to certain unidirectional and multidirectional motions. In many instances, limiting certain muscle and joint actions is very important when one is trying to heal from an injury such as a shoulder separation or rotator cuff tendonitis. Other prior art shirts have attempted to address disorders of the shoulder by adding various straining straps or fabric panels. Examples of shirts using straining straps or fabric panels are U.S. Pat. Nos. 5,937,442, 6,892,396, and 7,871,388. However, these shirts do not effectively limit certain muscle and joint actions for the arms, shoulders, and torso.

To prevent or treat shoulder injuries, special taping techniques to limit joint and muscle motions have been used for years in sports medicine. These taping techniques must be performed by persons possessing special skills and knowledge, and for hygienic reasons may only be used for short durations.

Until now there has not been a single garment that reproduces the arm, shoulder, and torso anatomy to provide specific unidirectional and multidirectional support to both muscle and joint action. There remains a pressing need for a compression shirt which is constructed to provide not only general compressive forces to the areas of the body covered by the shirt, but also to provide specific extra forces to certain areas of the body to limit certain undesired joint movements and muscle activities in the shoulders, arms, and torso. Specifically, a better upper body garment is needed for the prevention and treatment of shoulder instabilities, rotator cuff tendonitis, muscle weakness and strains, torso and abdominal muscle injuries, as well as for improving postural control.

SUMMARY

It is an object of the present invention to design a shoulder stabilization shirt, or other stabilization garment, that may create compression to areas of the body to provide stability and tension to protect injured or recovering muscles and joints. It also may be used to prevent shoulder or torso injuries, as well as improving postural control.

The instant application may provide more specific compressive protection to a wearer's upper body than that provided by prior art shirts. The shoulder stabilization shirt may be constructed of multiple strips of elastomeric material sewn together in an overlapping manner to form the shirt. These elastomeric strips may be oriented primarily in diagonal, overlapping configurations, which configurations have been determined to be particularly helpful in stabilizing, to some extent, a wearer's shoulder, arm, and torso areas, in addition to supporting the wearer's chest, back, and abdominal areas.

More particularly, one embodiment of the shoulder stabilization shirt has a front portion, a rear portion, and sleeve portions, with all these portions attached to one another at multiple left and right side seams. Like most traditional shirts, the shoulder stabilization shirt has a collar encircling the upper edges of the front, rear, and sleeve portions, a waistband formed at the lower edges of the front and rear portions of the shirt, as well as cuffs formed at the lower edge of the sleeve portion. Unlike traditional shirts, the shoulder stabilization shirt may also contain two sleeve portions on each side, attached in between the front and rear portions of the shirt as well as a reinforced waistband. Seams attaching the sleeve portions to the front and rear portions of the shirt may run directly from the collar down to the armpit portion of the shirt. The seams may be made of reinforced thread. This is in contrast to other t-shirts in which the seams attaching the sleeve portions to the front and rear portions of the shirt are positioned off-center from the collar at the top edge of the shoulder and run down to the under-arm portion of the shirt.

According to one embodiment, the waistband and cuffs may include a tacky surface which serves as an anti-skid device to keep the compression shirt positioned in correctly on the wearer's body.

Two groups of elastomeric strips of fabric may extend diagonally across the front portion of the shirt, while two groups of elastomeric strips of fabric may extend diagonally across the rear portion of the shirt, and two groups of elastomeric strips of fabric extend vertically across the sleeve portion. For clarification, the term "vertical" refers to the extension of the elastomeric material from the collar region down the top of the arm to the bottom cuff of the sleeve. The front and rear groups of elastomeric strips extend from the upper portion of the shirt diagonally to the lower portion of the shirt, from one side to the opposite, while the sleeve groups of elastomeric strips extend vertically along the side of the sleeve portion.

According to one embodiment, the seams of the compression shirt may serve as anchor points for the elastomeric strips. For example, one group of elastomeric strips may extend from a right-side seam of the front portion of the shirt to the top-rear sleeve seam of the left sleeve portion of the shirt. The use of a reinforced waistband and/or a tacky surface on the waistband and cuffs may reinforce the positioning of the anchor points, and thus the positioning of the strips, on the wearer's body.

According to another embodiment, the elastomeric strips may extend from the front portion or back portion of the shirt across each shoulder and/or each side of the collar bone of the wearer to the back portion or front portion of the shirt, respectively, to provide additional support to the arm, shoulder, and torso.

In a further embodiment, the elastomeric strips of fabric may extend diagonally from the oblique right and left seams of the garment at an angle of approximately 15 degrees to approximately 75 degrees relative to vertical centerline on the front and back between the collar and waist band. The angle of the strips may be selected to compress different muscle groups and portions of the wearer's upper body. To further exact a correct amount of compression, the strips may have a width of between approximately 2 inches and 12 inches. The angle of the strips and/or the width of the strips may further change depending on the size of the compression shirt (e.g. small, medium, large, extra large, etc.).

Other strips of the same material may also form the other portions of the shirt. The widths and sizes of the elastomeric strips may be changed arbitrarily as required.

In a further embodiment, the elastomeric material may be configured to form a front and/or back "x-shaped" panel that may extend from the back portion or front portion of the shirt across each shoulder and/or each side of the collar bone of the wearer to the front portion or back portion of the shirt, respectively. To further compress different muscle groups and/or provide further stability, additional elastomeric strips of fabric may be added to the garment.

The shape of the collar portion is not limited to that shown in the drawings, but may be changed arbitrarily as required, for instance to a crew-neck type, a v-neck type, a high-neck type, or a turtle-neck type, or a collared-neck type.

According to a further embodiment, an upper-body stabilization garment comprises: a plurality of elastomeric fabric strips having edges connected together by stretchable seams to form the garment which has a front, a rear and opposite arm sleeves each presenting a respective shoulder region that transitions between the front and rear of the garment, the garment having opposite side seams, wherein the plurality of elastomeric strips include: a first strip comprising a single elastomeric fabric section that begins at one of the opposite side seams and extends diagonally across the front, over the shoulder region opposite from the one side seam, extending diagonally across the rear and terminating at the said one opposite side seam; a second strip having at least one elastomeric fabric section that begins at the other of the opposite side seams, extends diagonally across the front portion, over the shoulder region opposite to the other of the opposite side seams, extending diagonally across the rear and terminating at the said other opposite side seam, wherein the first strip and the second strip cross each other on the front and rear of the garment to present respective X-patterns on the front and rear of the garment.

According to yet another embodiment the second strip comprises a plurality of elastomeric fabric sections including: a first section that has one edge connected to the other opposite side seam and an opposite edge connected to the first strip on the front by a lower oblique seam, a second section that has one edge connected to the first strip on the front by an upper oblique seam spaced apart from the lower oblique seam on the front and an opposite edge connected to the first strip on the rear by an upper oblique seam on the rear, and a third section having one edge connected to a lower oblique seam spaced apart from the upper oblique seam on the rear and an opposite edge connected at said other opposite side seam.

According to another embodiment, the second strip comprises a single elastomeric fabric section having opposite edges both connected at the other opposite side seam, wherein the single elastomeric section of the second strip extends diagonally across the front from the other of said opposite side seam, over the shoulder region opposite from the other opposite side seam, and diagonally across the rear, wherein the first and second strips cross one another on the front and rear of the garment to present overlapping regions.

The unique orientation and overlapping configurations of the elastomeric strips used in the construction of the shoulder stabilization shirt may provide specific compressive support to reduce movement and improve stability to a wearer's shoulder, arm, and torso areas, in addition may support the wearer's chest, back, and abdominal areas.

BRIEF DESCRIPTION OF THE DRAWINGS

In drawings which illustrate specific embodiments of the invention, but which should not be construed as restricting the spirit or scope of the invention in any way.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than restrictive, sense. Further, throughout the drawings, the words "right" and "left" are used in the sense of the wearer of the garment. Thus, the right side of the garment as worn is on the left side as viewed in the illustrated drawing. The "left" side of the garment as worn is on the right side as viewed in the illustrated drawing.

Figure 1:
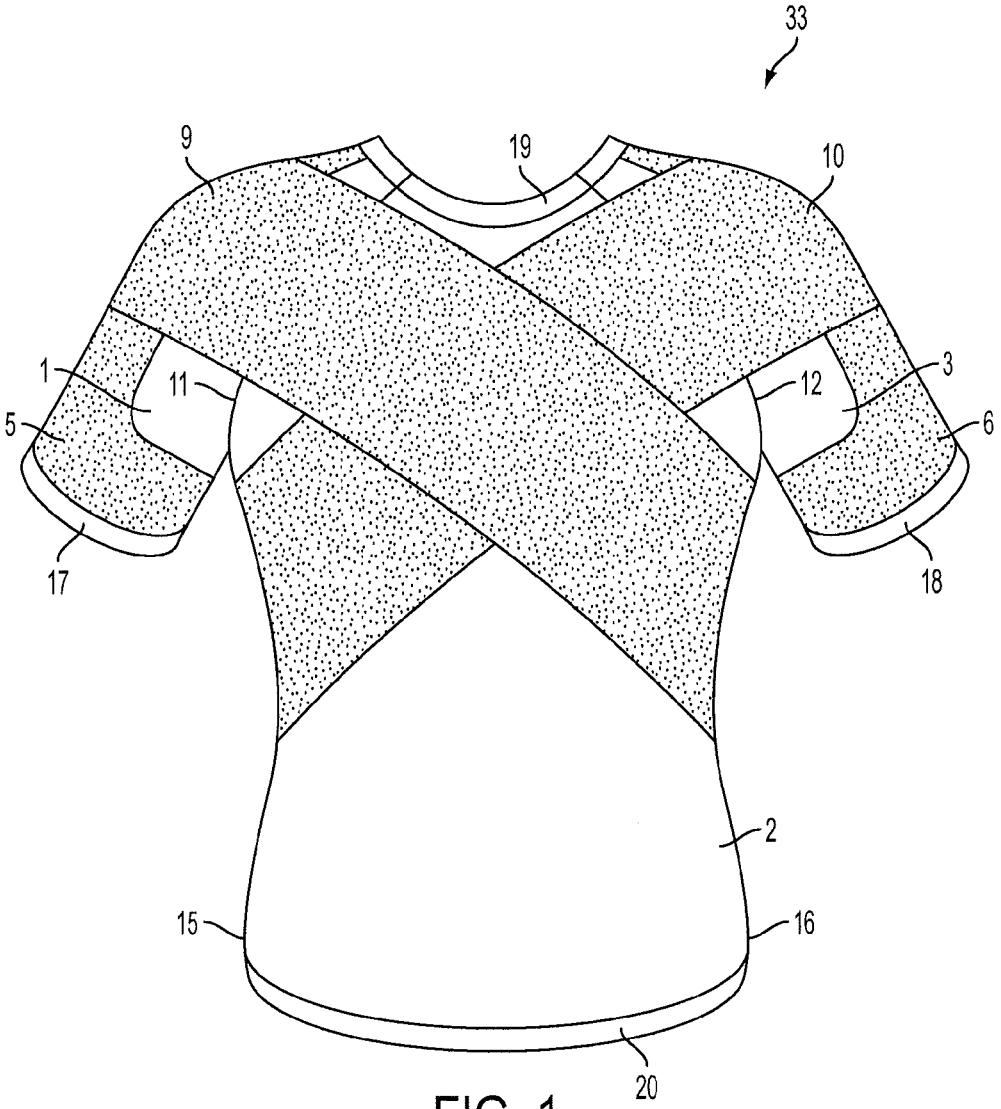
FIG. 1 is a front view of the compression shirt of one embodiment of the present invention.
Figure 3:
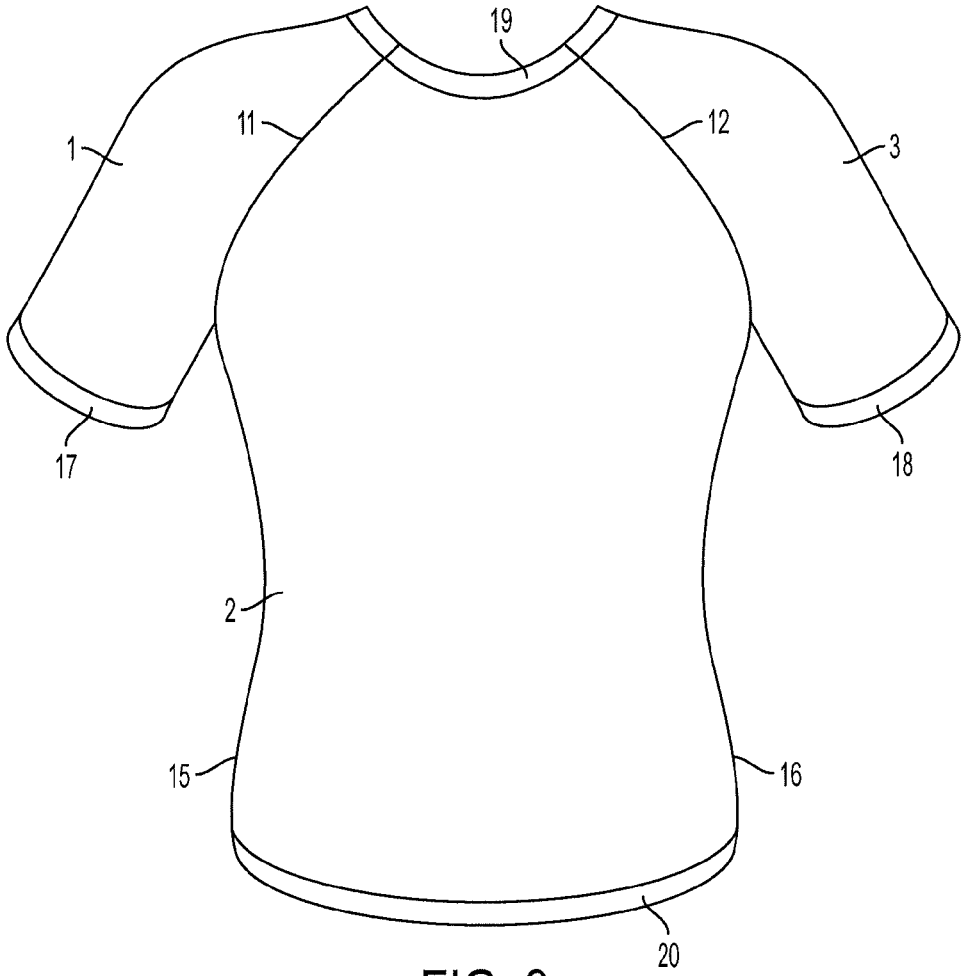
FIG. 3 is a front view of a shirt with no elastomeric strips attached.
Figure 4:
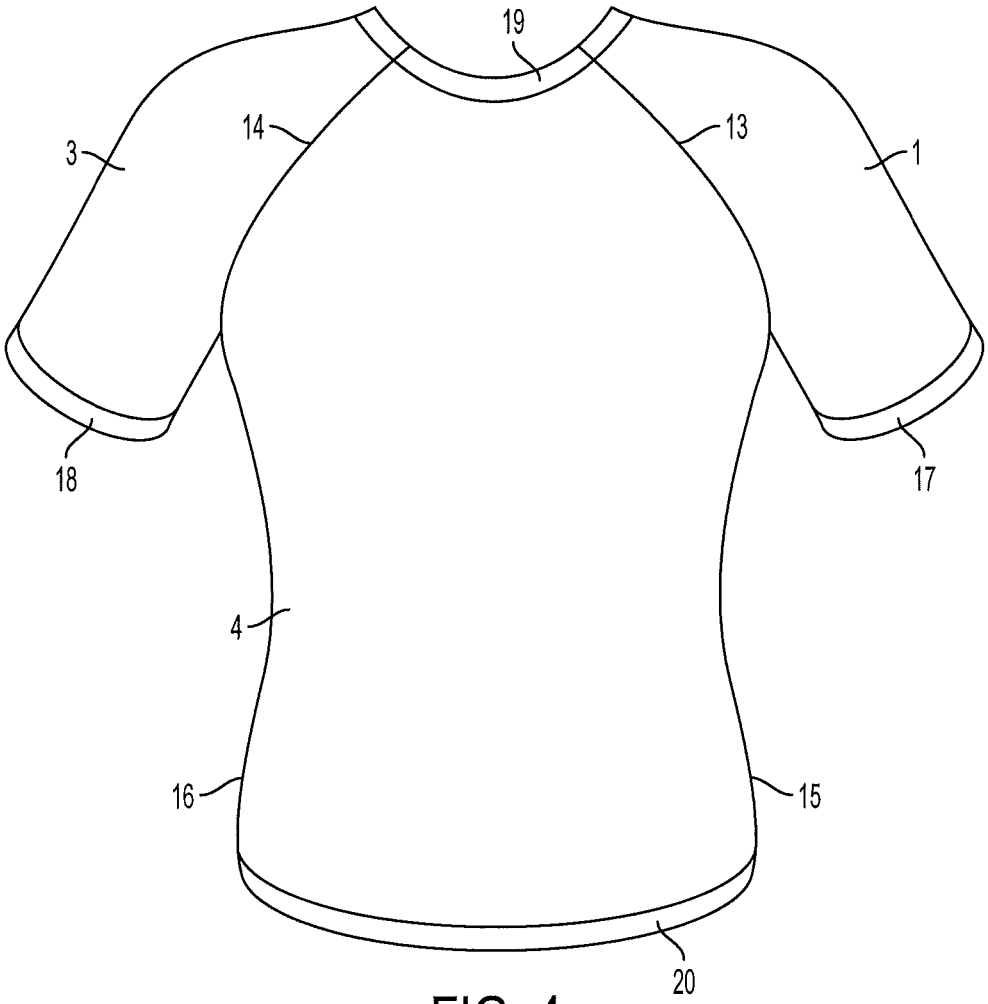
FIG. 4 is a rear view of the shirt illustrated in FIG. 3 with no elastomeric strips attached.

Referring first to FIG. 1, one embodiment of the compression shirt configured in accordance with the principles of the present invention is denoted generally herein by the numeral "33". Shirt 33 has a front portion 2, a rear portion 4, and right and left sleeve portions 1 and 3 respectively. Front and rear portions 2, 4 are attached to one another at right and left side seams. Right sleeve portion 1 is attached to front and rear portions 2, 4 at right front and rear oblique seams 11, 13. Left sleeve portion 3 is attached to front and rear portions 2, 4 at left front and rear oblique seams 12, 14. Right and left front oblique seams 11, 12 are shown in FIG. 3. Right and left rear oblique seams 13, 14 are shown in FIG. 4.

The shirt 33 may be long- or short-sleeved. The shirt may be made of a wicking or thermal material and may include a zipper or other fastening device to help the wearer put the shirt on. According to one embodiment, the shirt material may be a thinner wicking material to allow for airflow around the heavier elastomeric compression strips.

The shirt 33 may have a collar 19 which encircles the upper edges of front portion 2, rear portion 4, right and left sleeve portions 1, 3 of shirt 33, a waistband 20 which encircles the lower edges of front portion 2 and rear portions 4, and right cuff 17 and left cuff 18 formed by the lower edge of right and left sleeve portions 1, 3 respectively, although neither collar 19, waistband 20, nor cuffs 17, 18 are strictly necessary to the practice of the invention.

As shown in FIG. 1, the shirt of the present invention includes a first plurality 5 of elastomeric strips of fabric extend vertically along the right sleeve portion 1 from cuff 17 to collar 19, while a second plurality 6 of elastomeric strips of fabric extend vertically along the left sleeve portion 3 from cuff 18 to collar 19. As described above, the seams of the shirt 33 may be used as anchor points for the elastomeric strips to the shirt body.

Figure 2A:
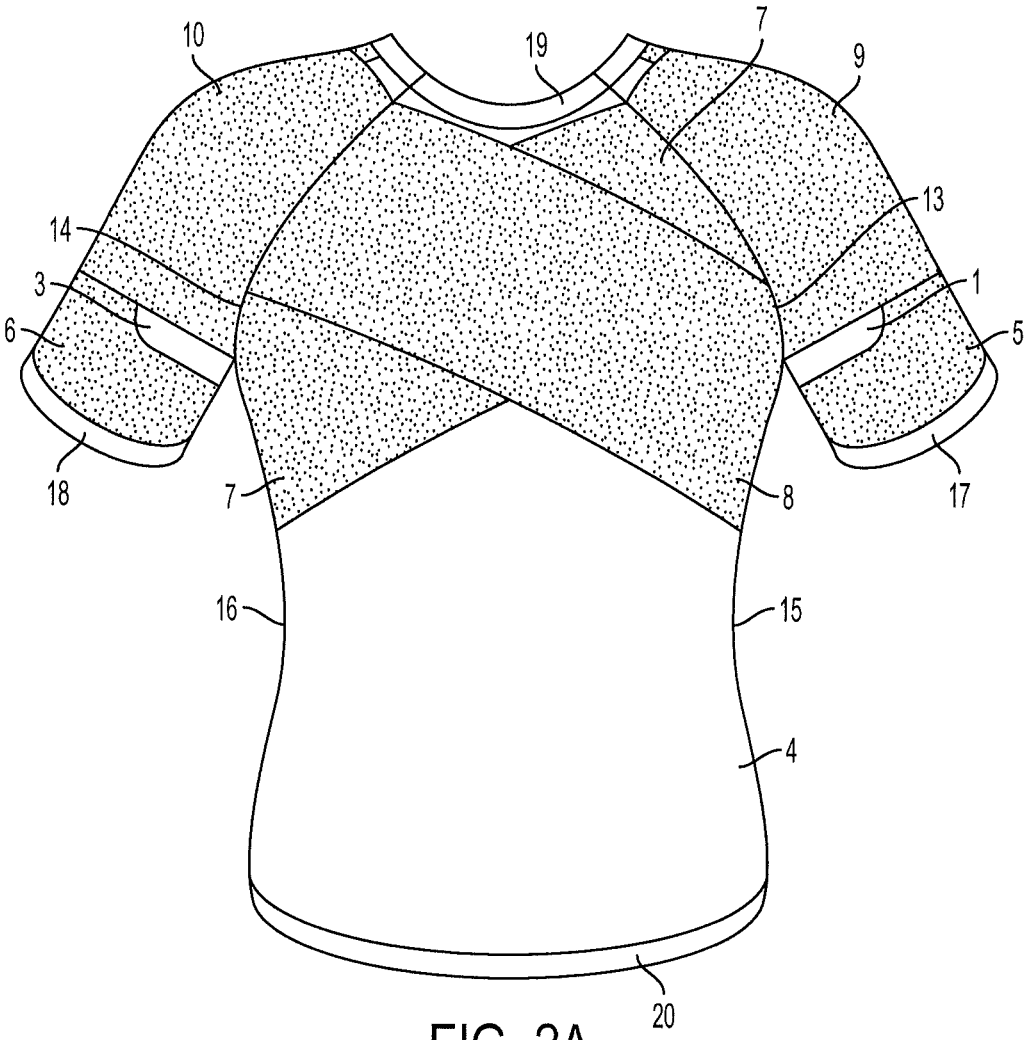
FIG. 2A is a rear view of the compression shirt of one embodiment of the present invention.

As shown in FIG. 2A, a third plurality 7 of elastomeric strips of fabric extend diagonally across rear portion 4 from right front oblique seam 11 (see FIG. 1) to an upper part of left side seam 16, while a fourth plurality 8 of elastomeric strips of fabric extend diagonally across rear portion 4 from left front oblique seam 12 (see FIG. 1) to an upper part of right side seam 15. The upper parts of left and right side seams 16, 15 are in close proximity to sleeve portions 1, 3. It is not essential to the invention that strip 7 originate precisely at seam 11 and terminate precisely at seam 16, or strip 8 originate precisely at seam 12 and terminate precisely at seam 15, but strips 7, 8 must extend substantially across the entirety of rear portion 4.

Figure 2B:
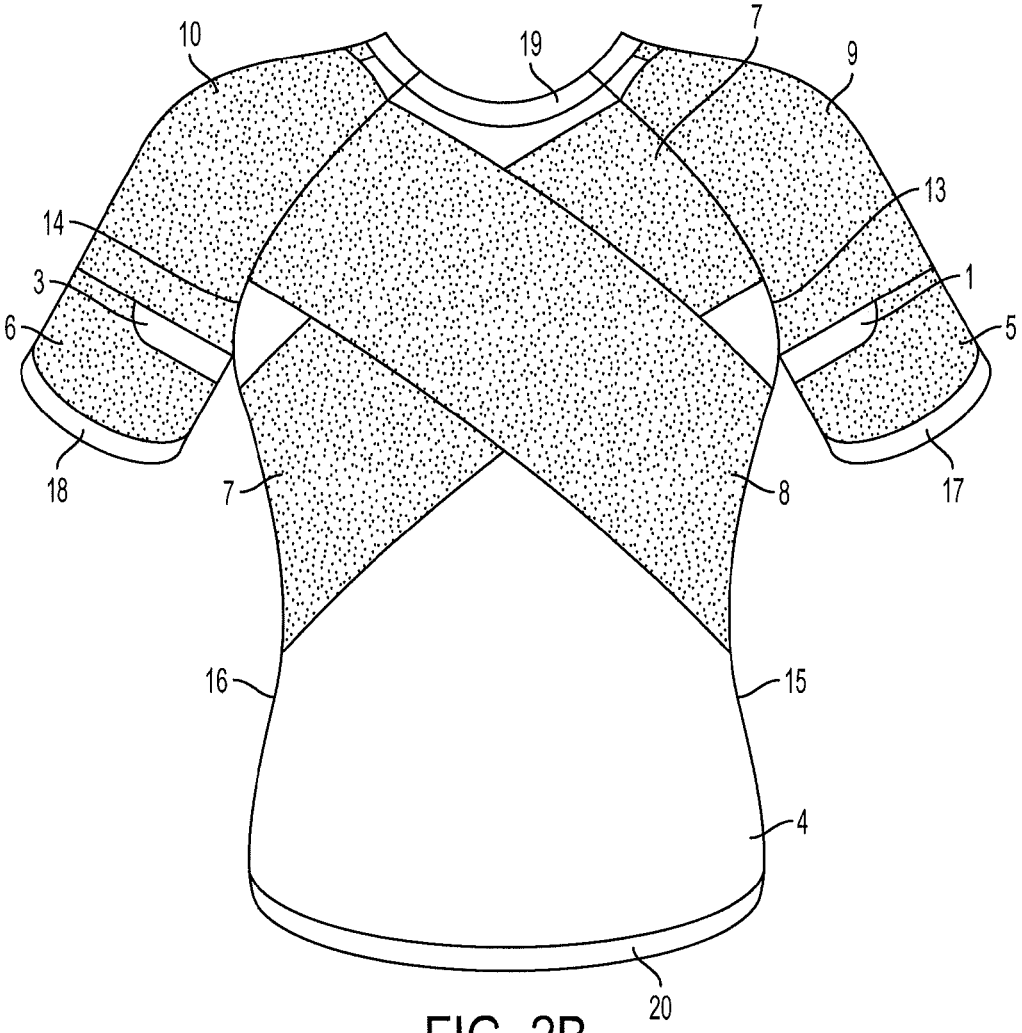
FIG. 2B is a rear view of the compression shirt of another embodiment of the present invention.

According to another embodiment, as shown in FIG. 2B, the third plurality 7 of elastomeric strips of fabric may extend diagonally across rear portion 4 from right front oblique seam 11 to a lower part of left side seam 16, while a fourth plurality 8 of elastomeric strips of fabric may extend diagonally across rear portion 4 from left front oblique seam 12 to a lower part of right side seam 15. The lower parts of left and right side seams 16, 15 are in closer proximity to the waistband 20. Whether the third and fourth plurality 7, 8 of elastomeric strips extend to the upper or lower parts of right and left side seams 15, 16 depends on the angle of the diagonal extension of the strips. The angle may be selected depending on which area of the wearer's upper body is to be compressed and/or the size of the wearer.

As shown in FIG. 1, a fifth plurality 9 of elastomeric strips of fabric extend diagonally across front portion 2 from right rear oblique seam 13 (see FIG. 2A) to a lower part of left side seam 16, while a sixth plurality 10 of elastomeric strips of fabric extend diagonally across front portion 2 from left rear oblique seam 14 (see FIG. 2A) to a lower part of right side seam 15. It is not essential to the invention that strip 9 originate precisely at seam 13 and terminate precisely at seam 16, or strip 10 originate precisely at seam 14 and terminate precisely at seam 15, but strips 9, 10 must extend substantially across the entirety of front portion 2.

The strips 5, 6, 7, 8, 9, 10 may be made of any elastomeric material, known in the sewing and fabric arts simply as "elastic". Adjacent strips of fabric are preferably attached to one another along their lengths, and most preferably are sewn together with stitching to form a plurality of strips of elastomeric fabric.

According to one embodiment, the strips of elastomeric fabric may be in a diagonally criss-crossing configuration. Even more particularly, the inventor has recognized that while shirt 33 could be made with a plurality of fabric strips extending diagonally at any angle relative to side seams 15, 16, a certain range of "steepness" of such strips provides better results. The inventor has determined that strips 7, 8 may extend diagonally across rear portion 4 at an angle between about 15-75 degrees relative a vertical centerline between collar 19 and waistband 20, and strips 9, 10 may extend diagonally across front portion 2 at an angle between about 15-75 degrees relative to a vertical centerline between collar 19 and waistband 20, while strips 5, 6 extend vertically along sleeve portions 1, 2 respectively.

Although it will be appreciated to those skilled in the art that any number of strips of fabric could be employed in place of the strips shown in the figures, one embodiment employs two strips for each of the first, second, third, fourth, fifth, and sixth pluralities of strips for ease of construction and to provide enhanced limitation of certain movements.

As shown throughout the figures, sleeve portion of shirt 33 may have right sleeve 1 terminating with cuff 17 and left sleeve 3 terminating with cuff 18. Right sleeve 1 has a right side seam 15, and left sleeve 3 has a left side seam 16. Each of sleeves 1, 3 may generally be configured to extend at least partially down the arm of the wearer.

Figure 5:
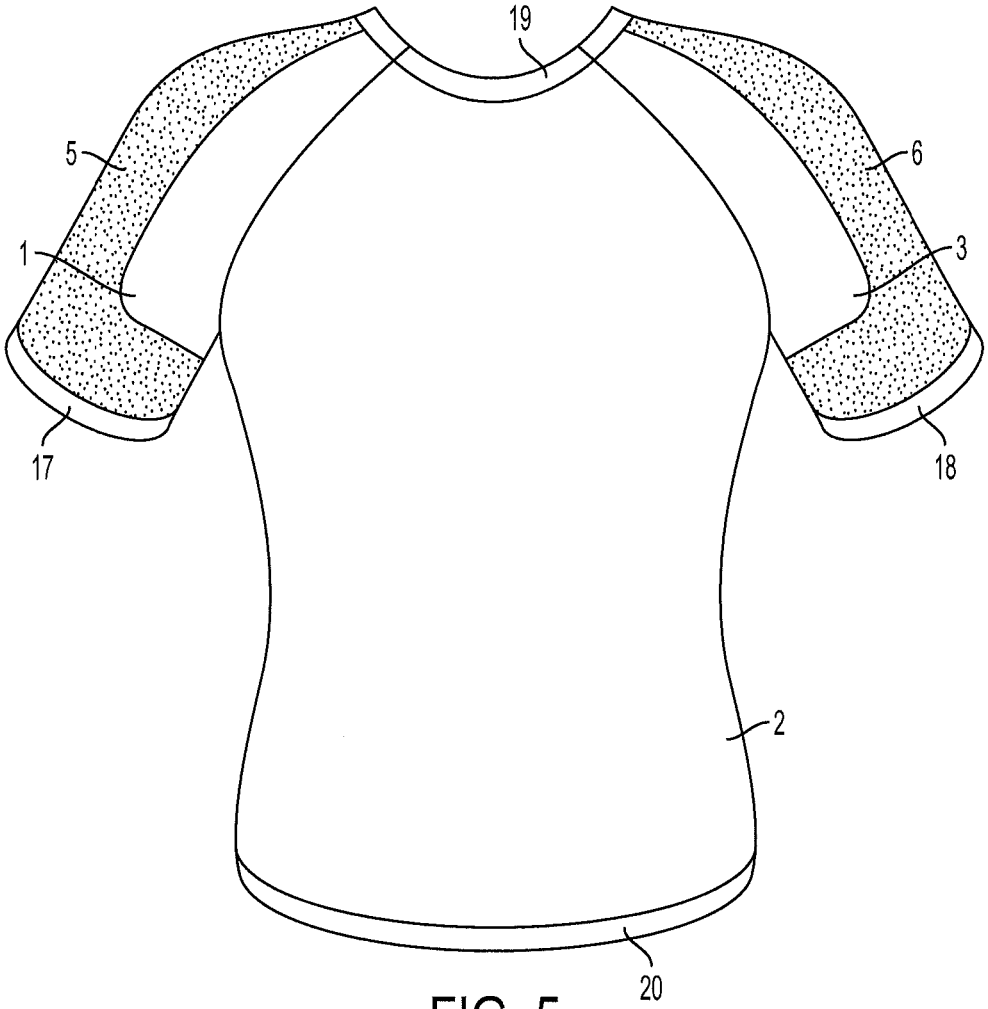
FIG. 5 is a front view of a compression shirt, according to an embodiment, with only the right and left vertical sleeve elastomeric strips attached.
Figure 6:
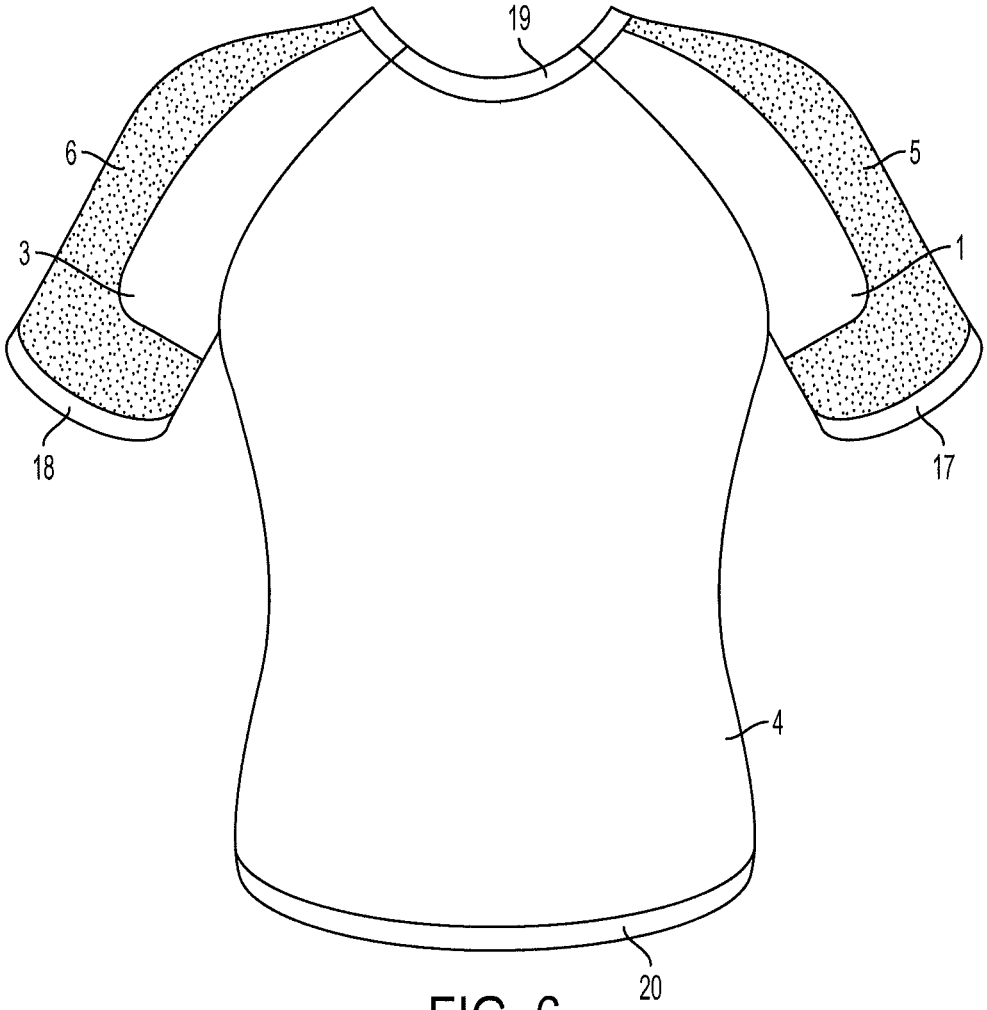
FIG. 6 is a rear view of the compression shirt illustrated in FIG. 5 with only the right and left vertical sleeve elastomeric strips attached.
Figure 7:
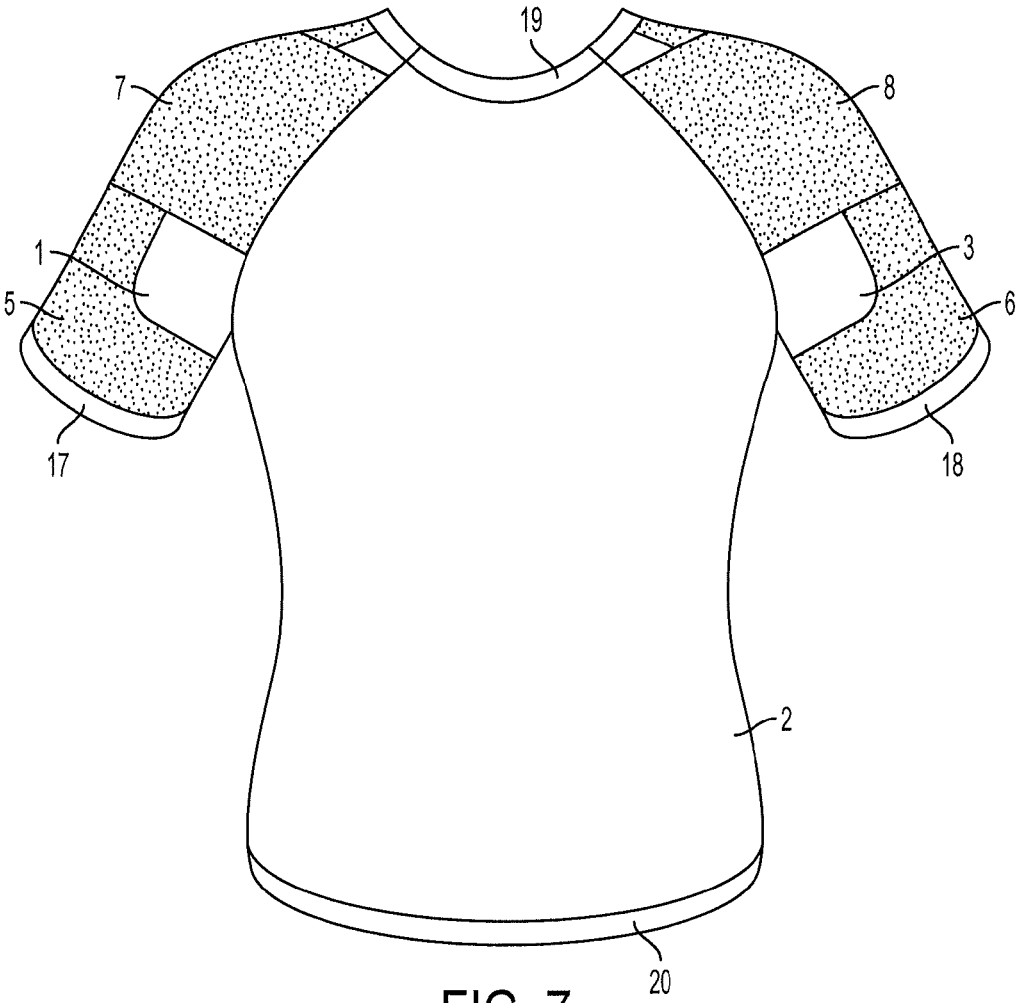
FIG. 7 is a front view of a compression shirt, according to another embodiment, with the right and left vertical sleeve elastomeric strips, as well as the right and left oblique rear elastomeric strips attached.
Figure 8:
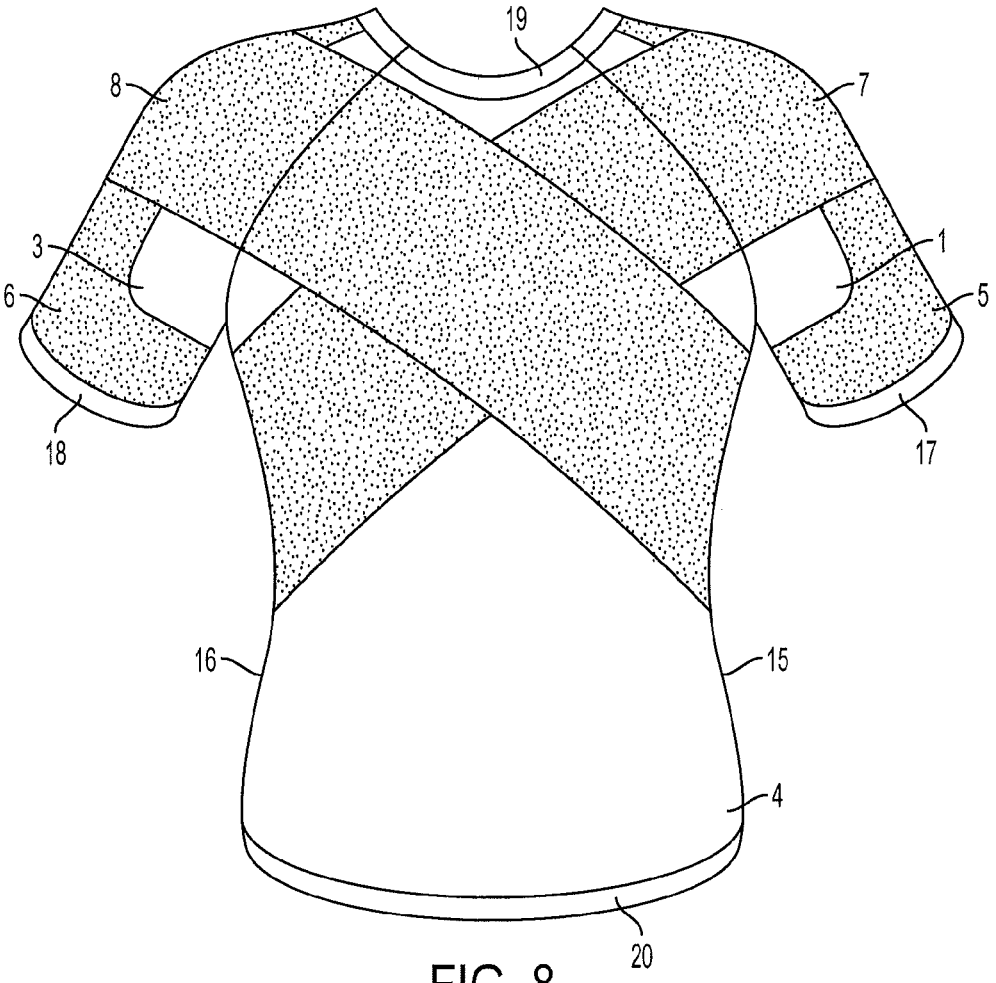
FIG. 8 is a rear view of a compression shirt, according to a further embodiment, with the right and left vertical sleeve elastomeric strips, as well as the oblique rear elastomeric strips attached.
Figure 9:
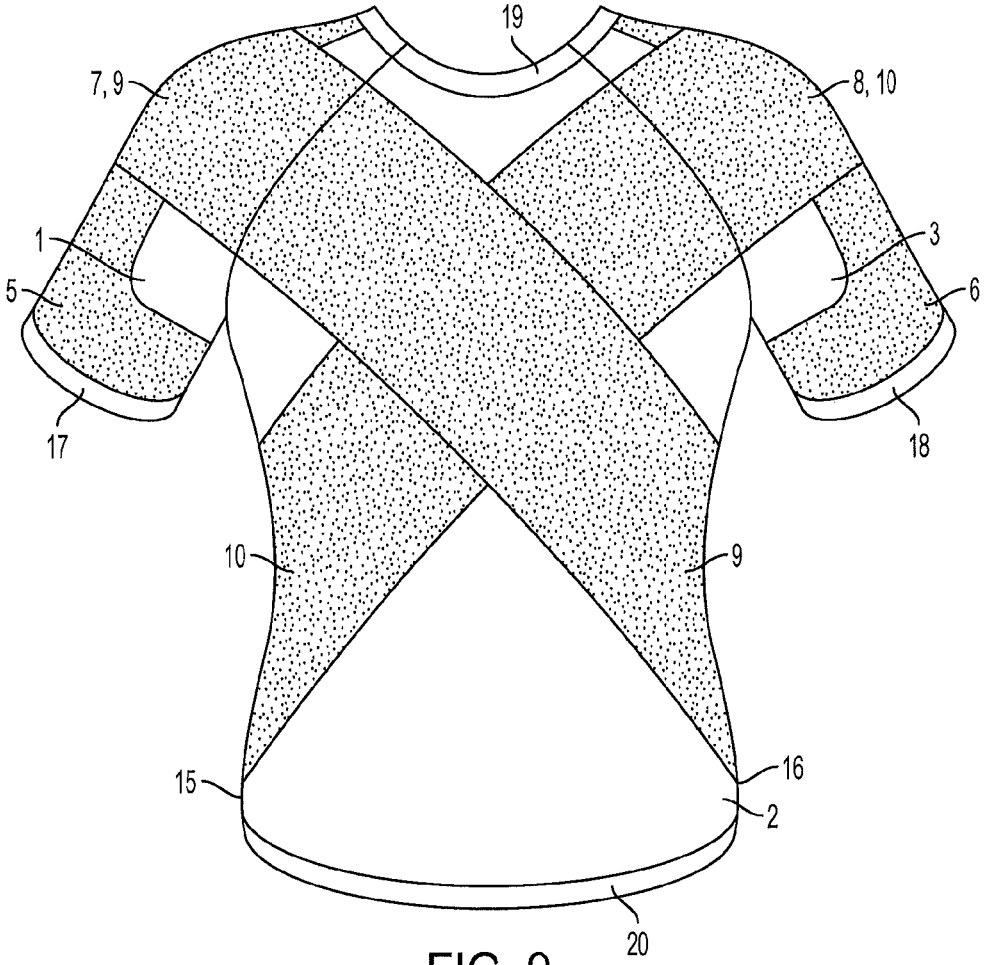
FIG. 9 is a front view of the compression shirt illustrated in FIG. 8 with the right and left vertical sleeve elastomeric strips, the right and left oblique rear elastomeric strips, as well as the right and left oblique front elastomeric strips attached.
Figure 10:
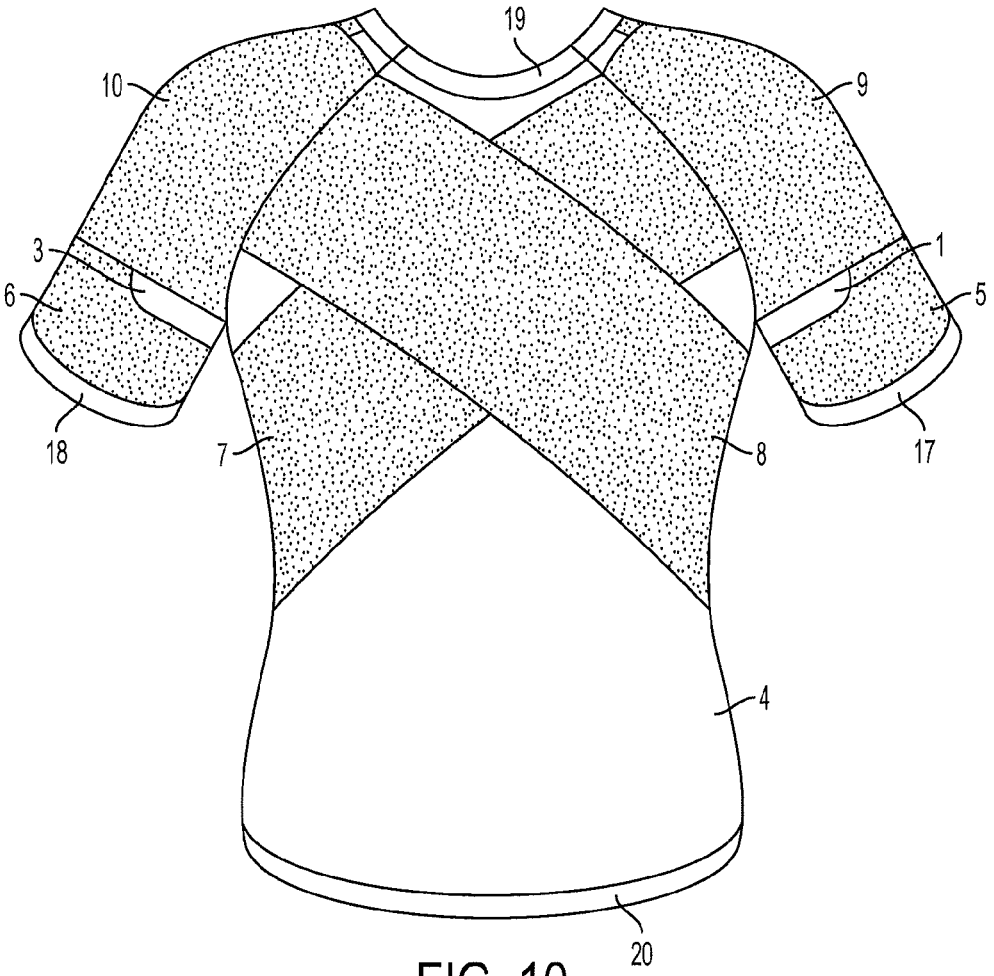
FIG. 10 is an alternative rear view of the compression shirt illustrated in FIG. 8 with the right and left vertical sleeve elastomeric strips, the right and left oblique rear elastomeric strips, as well as the right and left oblique front elastomeric strips attached.

FIGS. 5-10 show various other embodiments of the stabilization shirt. FIG. 5 is a front view of the compression shirt with only the right and left vertical sleeve elastomeric strips 5, 6 attached. FIG. 6 is a rear view of the compression shirt illustrated in FIG. 5 with only the right and left vertical sleeve elastomeric strips 5, 6 attached. FIG. 7 is a front view of the compression shirt with the right and left vertical sleeve elastomeric strips 5, 6, as well as the right and left oblique rear elastomeric strips attached 7, 8. FIG. 8 is a rear view of the compression shirt illustrated in FIG. 7 with the right and left vertical sleeve elastomeric strips 5, 6, as well as the oblique rear elastomeric strips 7, 8 attached. FIG. 9 is a front view of the compression shirt illustrated in FIG. 8 with the right and left vertical sleeve elastomeric strips 5, 6, the right and left oblique rear elastomeric strips 7, 8, as well as the right and left oblique front elastomeric strips 9, 10 attached. FIG. 10 is an alternative rear view of the compression shirt illustrated in FIG. 8 with the right and left vertical sleeve elastomeric strips 5, 6, the right and left oblique rear elastomeric strips 7, 8, as well as the right and left oblique front elastomeric strips 9, 10 attached.

Figure 11:
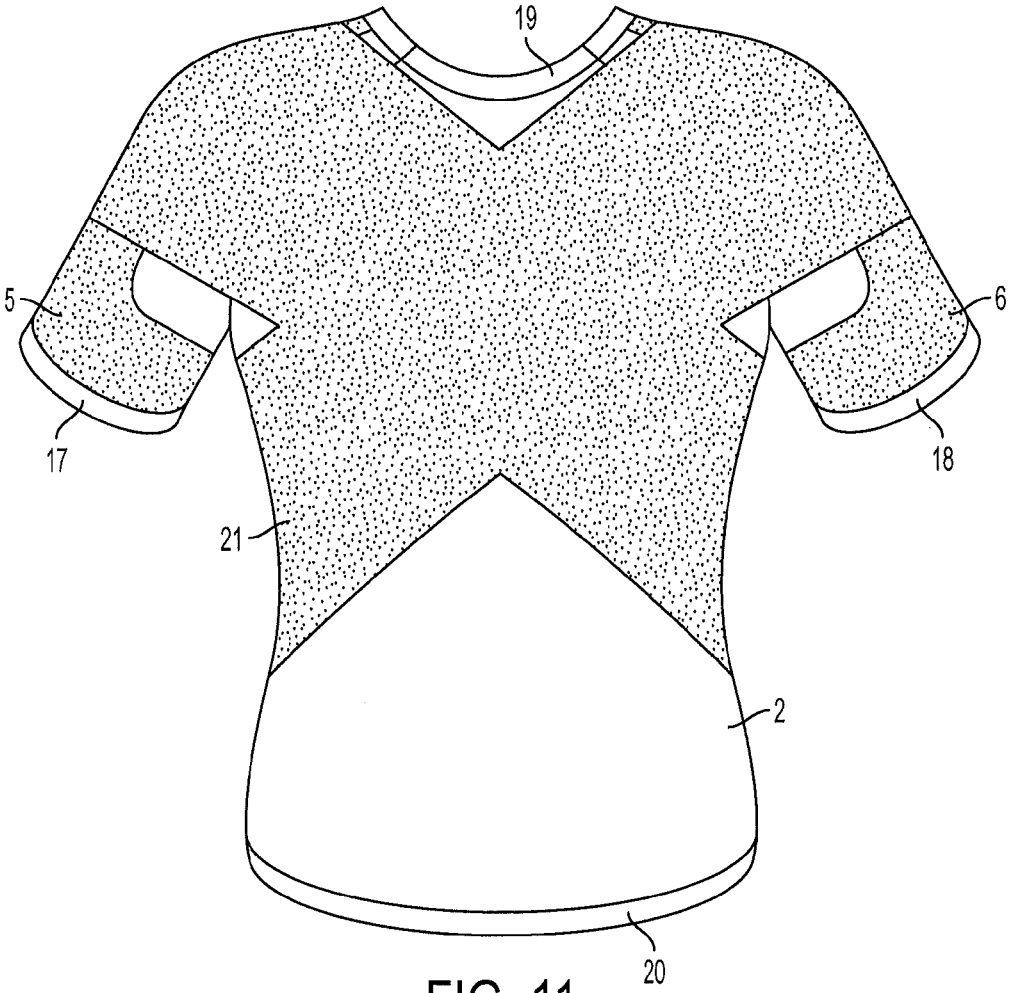
FIG. 11 is a front view of a compression shirt, according to an embodiment, with right and left vertical sleeve elastomeric strips and a front x-shaped elastomeric panel attached.

FIG. 11 is a front view of a compression shirt, according to an embodiment, with the right and left vertical sleeve elastomeric strips 5, 6, and a front "x-shaped" elastomeric panel 21 attached. The x-shaped panel 21 may be made of a single piece of fabric or multiple pieces of connected fabric.

Figure 12:
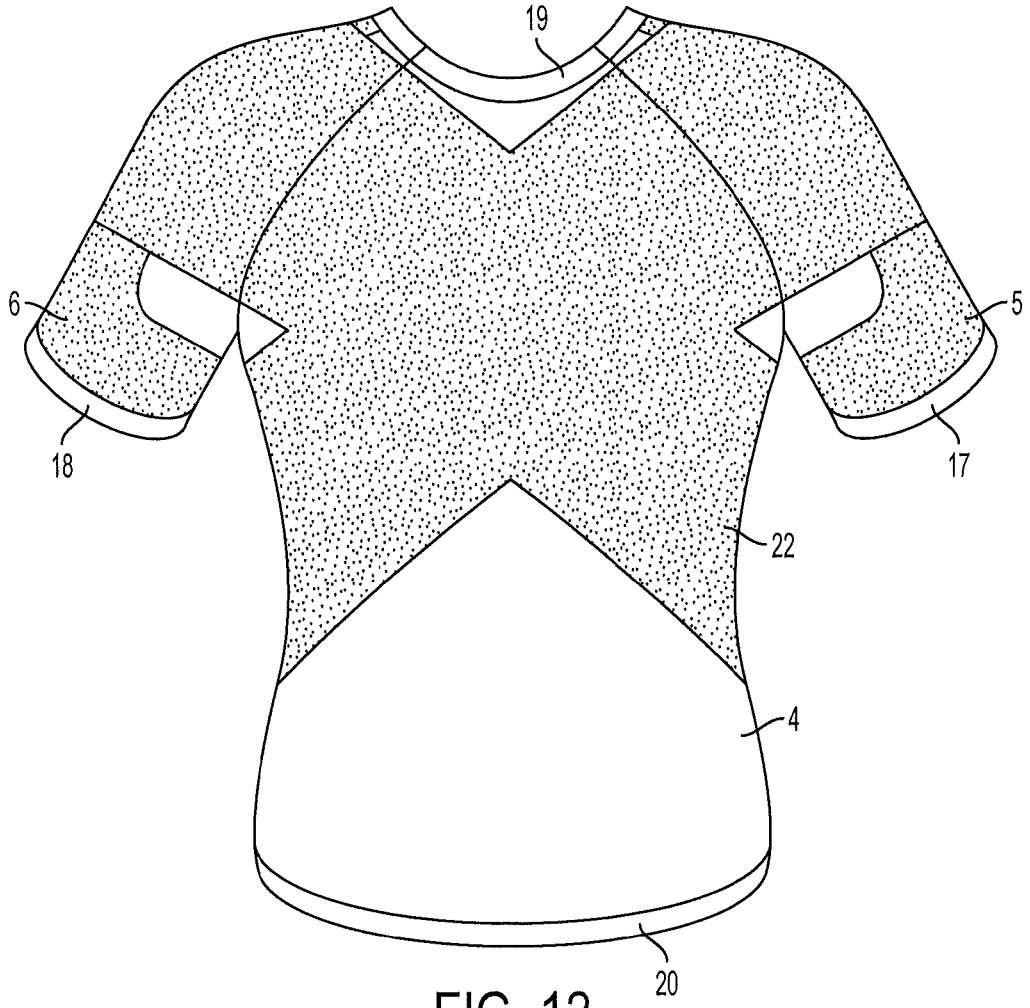
FIG. 12 is a rear view of the compression shirt illustrated in FIG. 11 with the right and left vertical sleeve elastomeric strips and a rear x-shaped elastomeric panel attached.

FIG. 12 is a rear view of the shirt illustrated in FIG. 11 with the right and left vertical sleeve elastomeric strips 5, 6 and a rear "x-shaped" elastomeric panel 22 attached. The x-shaped panel 22 may be made of a single piece of fabric or multiple pieces of connected fabric.

Figure 13:
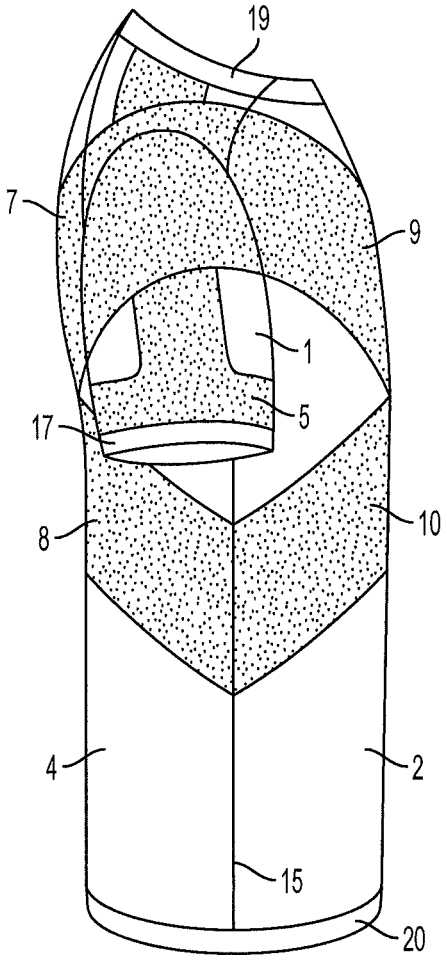
FIG. 13 is a right-side view of the shirt illustrated in FIG. 10 with the right vertical sleeve elastomeric strip, the right and left oblique rear elastomeric strips, as well as the right and left oblique front elastomeric strips attached.

FIG. 13 is a right-side view of the shirt illustrated in FIG. 10 with the right vertical sleeve elastomeric strip 5, the right and left oblique rear elastomeric strips 7, 8, as well as the right and left oblique front elastomeric strips 9, 10 attached.

Referring now FIG. 14-19, there is shown a compression garment 43 embodying many of the same principles as the previously discussed embodiments. According to this embodiment, the compression garment includes a plurality of elastomeric fabric strips connected together by stretchable seams, for example flat lock seams, to form the garment. The garment has a front 49, a rear 53, left and right arm sleeves 54*a*, 54*b*, and respective shoulder region 51, 58 that transition between the front and rear of the garment. The garment has opposite left and right side seams 47, 56. The elastomeric strips include a first strip 45 comprising a single elastomeric, fabric section that begins at one of the opposite side seams, for example left side seam 47 and extends diagonally across the front, over the right shoulder region 51 opposite from the left side seam 47, extending diagonally across the rear and terminating again at the left side seam 47. A second strip 55 having one or a plurality of elastomeric, fabric sections begins at the other (right) side seam 56 (not visible in FIG. 14), extends diagonally across the front, over the left shoulder region 58 opposite to right side seam 56, extending diagonally across the rear and terminating again at the right side seam 56 (see FIGS. 15, 16). The first and second strips cross each other on the front and rear to present respective X-patterns on the front and rear of the garment.

Figure 14:
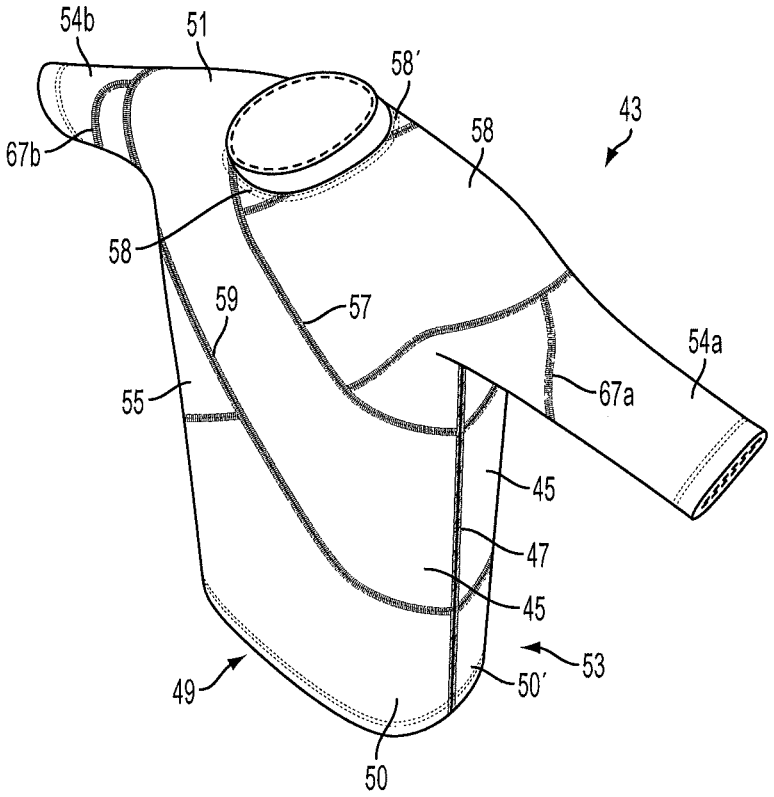
FIG. 14 is a perspective view of another embodiment of a compression shirt according to the present invention.
Figure 15:
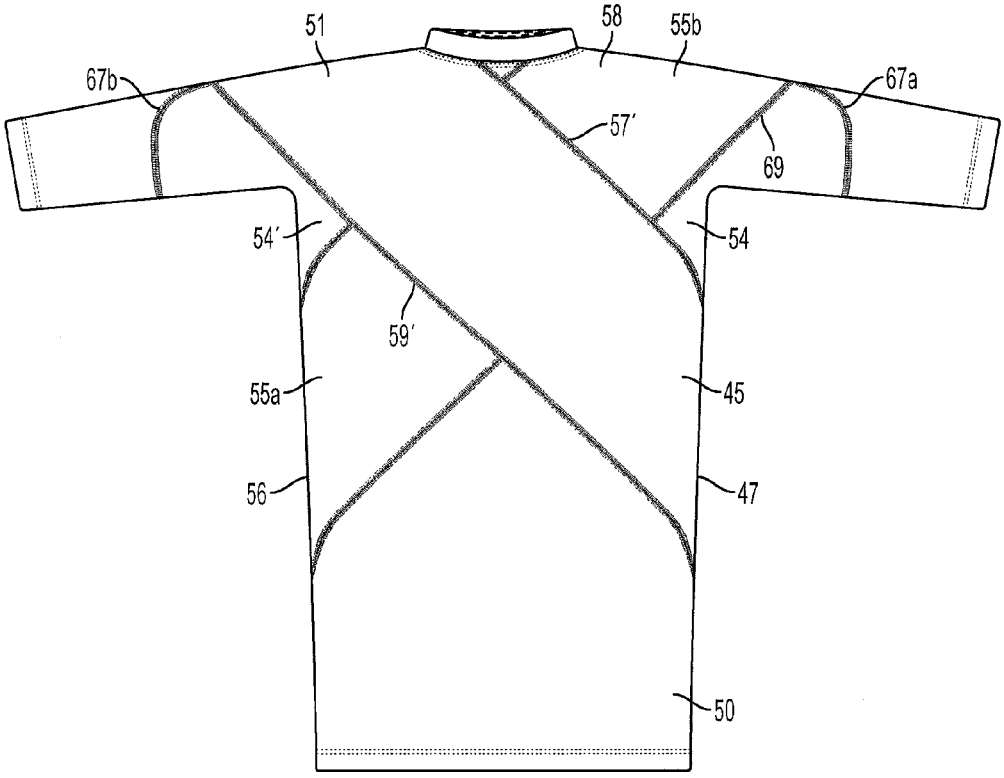
FIG. 15 is a front view of variation of the embodiment of FIG. 14.
Figure 16:
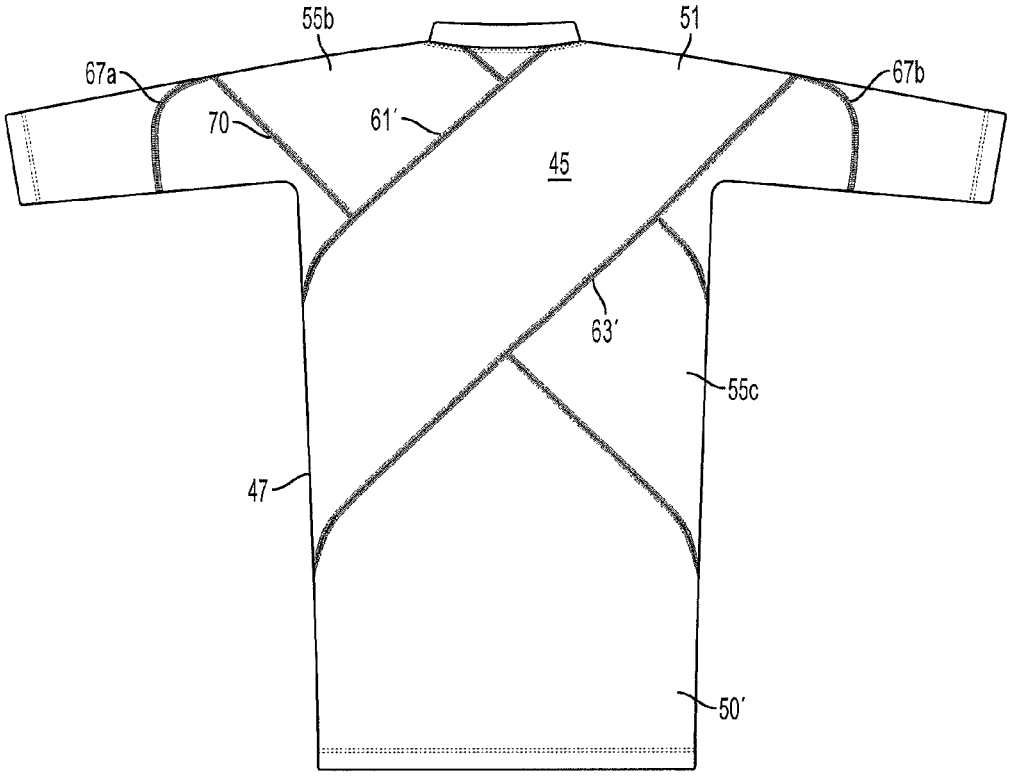
FIG. 16 is a rear view the embodiment of FIG. 15.

The X-pattern may be made on the one hand with a single or common elastomeric strip section 45 that starts and terminates at the same side seam, for example the left side seam 47 as shown in the drawing figures; and on the other hand with a second strip 55 that may comprise either a single section that begins and terminates at the other side seam as shown in FIG. 14, or from a plurality of sections 55*a*, 55*b* and 55*c* as shown in FIGS. 15 and 16. Lower front and rear fabric sections or panels 50, 50', upper side sections or panels 54, 54', upper center sections 58, 58', together with sleeve cuffs 17, 18, collar 19 and waist band 20 complete the garment.

In the embodiment of FIG. 14, the second elastomeric strip 55 comprising a single section may overlap the single elastomeric strip section 45 on the front and rear. On the front of the garment, in the overlapping, crisscrossing regions, the outer strip, for example strip 45 may be connected to the inner strip 55, by upper and lower spaced-apart oblique seams 57 and 59. Similar upper and lower spaced-apart oblique seams on the back connect the outer and inner strips in the overlapping regions (not visible in FIG. 14).

The embodiment of FIGS. 15 and 16 is a variation of the embodiment of FIG. 14, wherein the second strip 55 comprises multiple sections 55*a*, 55*b* and 55*c*. On the front of the garment, oblique seam 59' connects the edge of section 55*a*, to the lower edge of strip 45 and seam 57' spaced-apart from seam 59' connects one edge of section 55*b* to the upper edge of strip 45. On the rear of the garment, the opposite end of section 55*b* is connect by upper oblique seam 61' to the upper edge of strip 45, and one end of section 55*c* is connected to the lower edge of strip 45 by another oblique seam 63' which is spaced apart from upper oblique seam 61'. The compression forces are essentially in the embodiment of FIG. 14 and the embodiment of FIGS. 15, 16. Obviously, if a single elastomeric strip section is used for each strip 45 and 55, as shown in FIG. 14, so as to present overlapping regions, more elastomeric material is required to fabricate the garment, although the fabrication is rendered somewhat easier. On the other hand, if one of the strips forming the X-pattern comprise multiple sections, for example sections 55*a*, 55*b* and 55*c* as reflected in FIGS. 15 and 16, less material is utilized, but the fabrication is rendered somewhat more complex.

Figure 17:
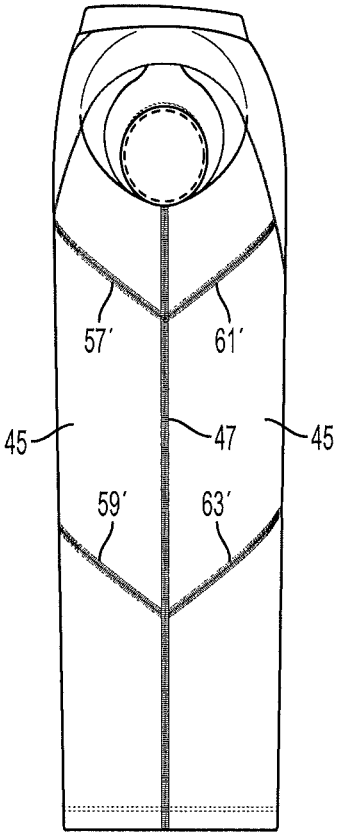
FIG. 17 is a side view of the embodiment of FIGS. 15 and 16.
Figure 18:
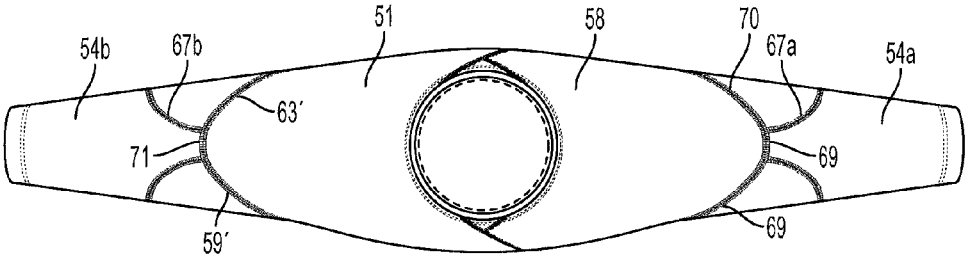
FIG. 18 is a top view of the embodiment of FIGS. 15 and 16.
Figure 19:
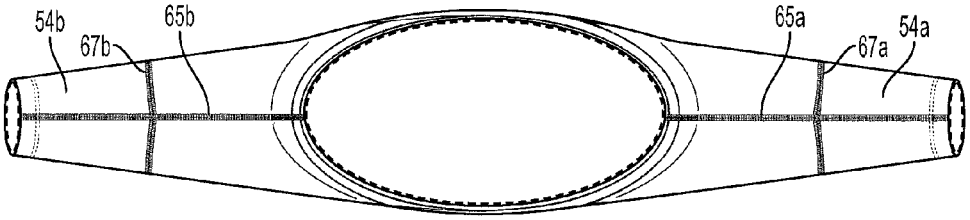
FIG. 19. is a bottom view of the embodiment FIGS. 15 and 16.

FIG. 17 is a left side view of the embodiment of FIGS. 15 and 16 showing the convergence of the oblique seams with the left side seam, Referring to FIGS. 18 and 19, the left and right arm sleeves 54*a*, 54*b* may be formed of single elastomeric strips connected by respective bottom seam 65*a*, 65*b*, respective sleeve seams 67*a*, 67*b*, and short seams 69, 71 on the left and right as shown in FIG. 18. In the embodiment of FIGS. 15 to 19, the garment essentially comprises a single layer of fabric throughout, except for example at the waist band, sleeve cuffs and collar.

In the embodiments shown in FIGS. 14-19, the strip 45, may extend diagonally on the front and rear, respectively, at an angle of approximately 15-75 degrees relative to a vertical centerline between the collar and waistband, and strip 55 in FIG. 14 and strip sections 55*a*, 55*b* and 55*c* in FIGS. 15-19 may also extend diagonally on the front and rear, respectively, at an angle of approximately 15-75 degrees relative to a vertical centerline between the collar and waistband, and the first and second strips may have a width of between approximately 2 inches and approximately 12 inches.

In a preferred embodiment, the seams of the criss-cross pattern may be made of a different color from the color of the fabric used for the elastomeric strips and the remaining portions of the garment. This presents an interesting visual effect, but has no impact on the management of the compression forces which are determined by the criss-cross patterns of the elastomeric strips and the location of the seams. The seams connecting together the various elastomeric strips may be of the well-known flat lock type.

A compression shirt is described which provides specific compression to reduce movement and improve stability in certain areas of a wearer's upper body. Compression may be applied to the wearer's upper body via one or more elastomeric strips of fabric. The strips may be oriented in diagonal and/or overlapping configurations across the shirt. The strips may comprise either a single strip running uniquely, or a plurality of strips in a sequential pattern. According to one embodiment, two groups have approximately three elastomeric strips of fabric overlap across the side portions of the shirt, with one strip extending diagonally across the front portion, one strip extending diagonally across the rear portion, and one strip extending vertically across the side portion of the shirt. The strips extending from the upper portion of one side of the shirt diagonally to the lower portion of the opposite side of the shirt overlap with the corresponding strips from the other side According to the various embodiments described above, the upper-body stabilization garment may create compression and provide stability and tension to protect injured or recovering muscles and joints. The garment may also be used to prevent shoulder or torso injuries, as well as improving postural control, for daily use, or during sports or training activities such as football, hockey, baseball, tennis, golf, rugby, lacrosse, weight lifting, cricket, basketball, track and field, gymnastics, martial arts, volleyball, soccer, field hockey, softball.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the aforementioned claims.

What is claimed is:

1. An upper-body stabilization garment, comprising:

a plurality of elastomeric fabric panels having edges connected together by stretchable seams;

a plurality of separate elastomeric strips attached to the plurality of elastomeric fabric panels by stretchable seams to form the garment which has a front, a rear and opposite arm sleeves each presenting a respective shoulder region that transitions between the front and rear of the garment, the garment having first and second opposite side seams, wherein the plurality of elastomeric strips include:

a first strip having first and second opposite ends with respectively first and second widths, the first strip comprising a single elastomeric fabric section that begins with the entire first width of the first end being connected to the first opposite side seam and extends diagonally across the front, over the shoulder region opposite from the first opposite side seam, extending diagonally across the rear and terminating with the entire width of the second end being connected to the first opposite side seam;

a second strip having third and fourth opposite ends with respectively third and fourth widths, the second strip comprising at least one elastomeric fabric section that begins with the entire width of the third end being connected to the second opposite side seam, extends diagonally across the front portion, over the shoulder region opposite to the second opposite side seam, extending diagonally across the rear and terminating with the entire width of the fourth end being connected to the second opposite side seam, wherein the first strip and the second strip present respective X-patterns on the front and rear of the garment.

2. The upper-body stabilization garment according to claim 1, wherein the second strip comprises a plurality of elastomeric fabric sections including:

a first section that has a first edge, constituting the third end, connected to said second opposite side seam and an opposite second edge connected to the first strip on the front by a lower first oblique seam, a second section that has a third edge connected to the first strip on the front by an upper second oblique seam spaced apart from the lower oblique seam on the front and an opposite fourth edge connected to the first strip on the rear by an upper third oblique seam on the rear, and a third section having a fifth edge connected to a lower fourth oblique seam spaced apart from the upper third oblique seam on the rear and a sixth edge, constituting the fourth end, connected at said second opposite side seam.

3. The upper-body stabilization garment according to claim 1, wherein the at least one elastomeric section of the second strip comprises a single elastomeric fabric section having opposite first and second edges, constituting the third and fourth ends, both connected at said second opposite side seam, wherein the single elastomeric section of the second strip extends diagonally across the front from the said second opposite side seam, over the shoulder region opposite from said second opposite side seam, and diagonally across the rear, wherein the first and second strips cross one another on the front and rear of the garment to present overlapping regions.

4. The upper-body stabilization garment according to claim 3, wherein an outer one of the first and second strips in the overlapping regions has spaced apart oblique edges on the front and the rear of the garment that are at least connected by edge seams to the underneath one of the first and second elastomeric strips in the overlapping regions.

5. The upper-body stabilization garment of claim 1, wherein the first and second strips extend diagonally at an angle of approximately 15 degrees to approximately 75 degrees relative to a vertical centerline on the front and rear of the garment.

6. The upper-body stabilization garment of claim 1, wherein the first and second strips have a width of between approximately 2 inches and approximately 12 inches.

* * * * *